United States Patent [19]

Poms et al.

[11] Patent Number: 5,072,750

[45] Date of Patent: Dec. 17, 1991

[54] FIRE HYDRANT CLOSURES

[76] Inventors: Ariah Poms; Yaacov Poms, both of 18 Messilat Wolfson, Tel Aviv, Israel

[21] Appl. No.: 548,004

[22] Filed: Jul. 5, 1990

[30] Foreign Application Priority Data

Jul. 18, 1989 [IL] Israel ..... 91016

[51] Int. Cl.[5] ..... F16K 31/08; F16K 35/16

[52] U.S. Cl. ..... 137/296; 70/175; 70/231; 70/232; 81/176.1; 137/377; 137/800; 192/84 PM; 220/724; 220/284; 220/293; 251/65; 251/291; 403/1; 403/DIG. 1

[58] Field of Search ..... 137/296, 382.5, 800, 137/377, 382; 220/85 P, 284, 285, 286, 293, 298; 251/65, 155, 291, 292, 89; 70/175, 239, 231, 232, 276, 413; 81/125, 176.1, 176.15, 176.2; 192/84 PM; 403/1, 19, DIG. 1

[56] References Cited

U.S. PATENT DOCUMENTS

| | | | |
|---|---|---|---|
| 3,840,041 | 10/1974 | McMurray | 137/296 |
| 3,916,939 | 11/1975 | Gillard | 137/296 |
| 4,182,361 | 1/1980 | Oakey | 137/296 |
| 4,390,038 | 6/1983 | Salvato | 137/296 |
| 4,526,193 | 7/1985 | Drach | 137/296 |
| 4,602,654 | 7/1986 | Stehling et al. | 220/284 |
| 4,620,428 | 11/1986 | Kopesky | 251/65 |
| 4,716,922 | 1/1988 | Camp | 137/296 |

*Primary Examiner*—George L. Walton
*Attorney, Agent, or Firm*—Edwin D. Schindler

[57] ABSTRACT

Improvements relating to fire hydrant closures are disclosed in which a cap-shaped cover for the outflow port from a fire hydrant, and a tool for locking and unlocking the cap on the hydrant, is provided. The cap includes a septum-like strong plate which is freely rotatable with the cap, but which is fixed against axial movement relative to the cap. Such septum-like plate, including means for mating engagement with corresponding means at the outflow spigot. The plate further includes means constructed to become engaged by the tool; the tool having a grip portion and a mating portion with a corresponding portion provided on the cap.

4 Claims, 2 Drawing Sheets

I-I
II-II
III-III
IV-IV

FIRE HYDRANT CLOSURES

The present invention relates to fire hydrants and more particularly to hydrants erected in public places.

Such conventional fire hydrants as is well known have an outflow port which is controlled by a valve to be operated by means of an appropriate tool, such as a spanner or pipe key or the like. The stem of the valve onto which the said tool fits is usually enclosed by a protecting cap or sleeve. The outflow port is conventionally sealed by a set on lid or cover. The so obtained protection of the stem and outflow prevents unauthorized access to the stem and outflow port and theft of water. The outflow port is usually in a short spigot like extension which the said lid or cover is secured by means of bayonet catch or screw thread to which end the spigot like extension has claw- or hook like members at its periphery, or is provided with a screw thread.

It has been found that the conventional lids or covers on the outflow port do not sufficiently safeguard the outflow from the hydrant against theft of water, since these covers or lids can be tampered with or even destroyed which leaves the thief with the more simple task of working the valve and unauthorizedly establish a flow of water from the fire hydrant.

It is therefore the object of this invention to provide means which effectively prevent the theft of water or at least make this diffucult.

It is a further object of this invention to provide a so called sealed cover or lid.

Yet a further object of this invention is to provide security means for hydrants to which only by a specially designed tool access will be available.

Figures 1, 1A, 1B, 1C, 1D:
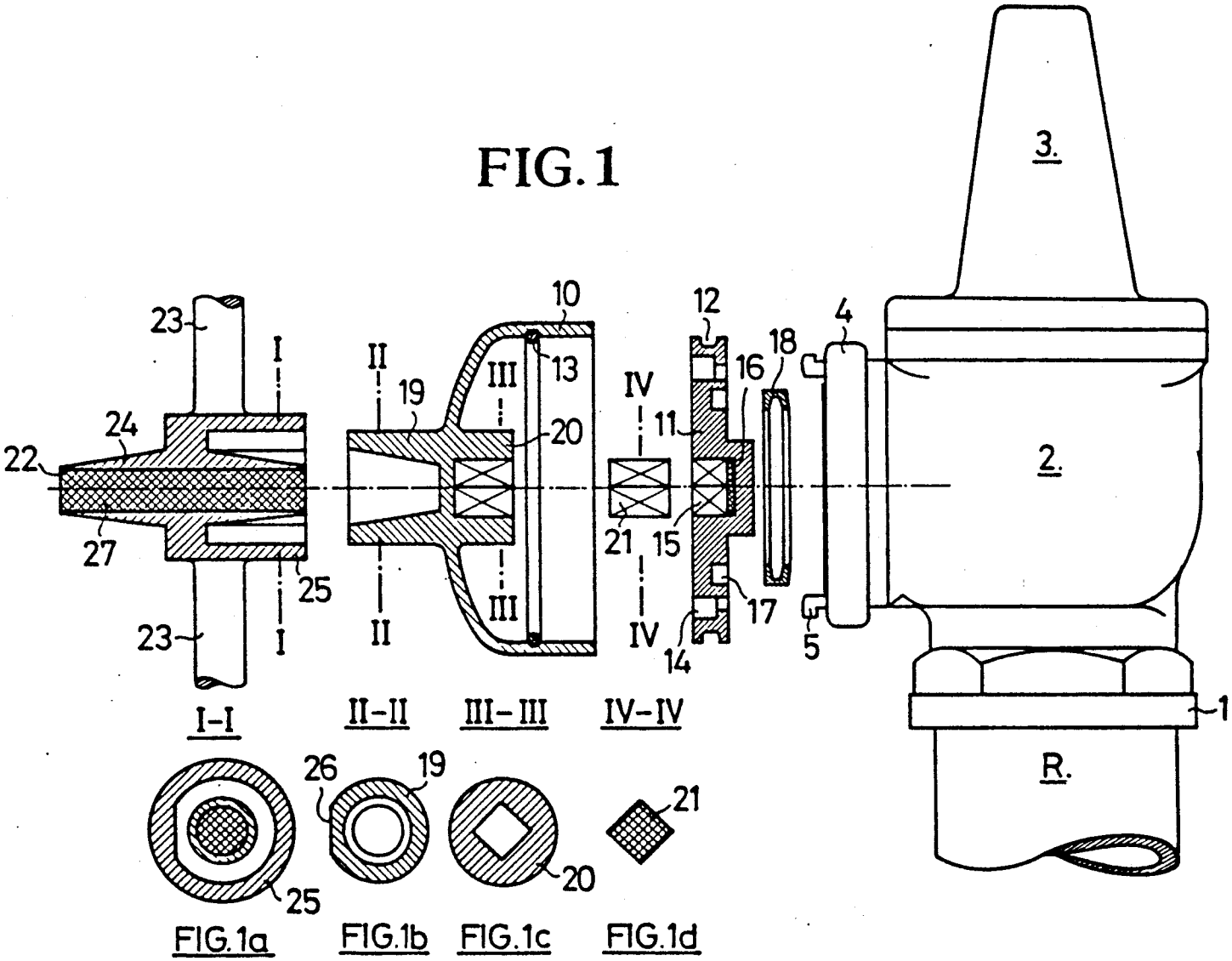

To achieve this object there is provided according to the invention a set comprising a cap shaped cover for the outflow port from a fire hydrant and a tool for locking and unlocking the cap on the hydrant, the said cap comprising a septum like strong plate which is freely rotatable within the cap but is fixed against axial movement relative to the cap, such septum like plate including means for mating engagement with corresponding means at the outflow spigot, the said plate further including means designed to become engaged by the said tool which latter comprises a grip portion and a mating portion with a corresponding portion provided on said cap. This and further features of the invention will become clear from the following description which will now be described with reference to the accompanying drawings wherein:

FIG. 1 is an exploded view of the new means in position in front of a conventional fire hydrant.

FIG. 1*a* is a section on line I—I of FIG. 1.

FIG. 1*b* is a section on line II—II of FIG. 1.

FIG. 1*c* is a section on line III—III of FIG. 1.

FIG. 1*d* is a section on line IV—IV of FIG. 1.

FIG. 1*e* shows an embodiment of a specific part.

Figure 2:
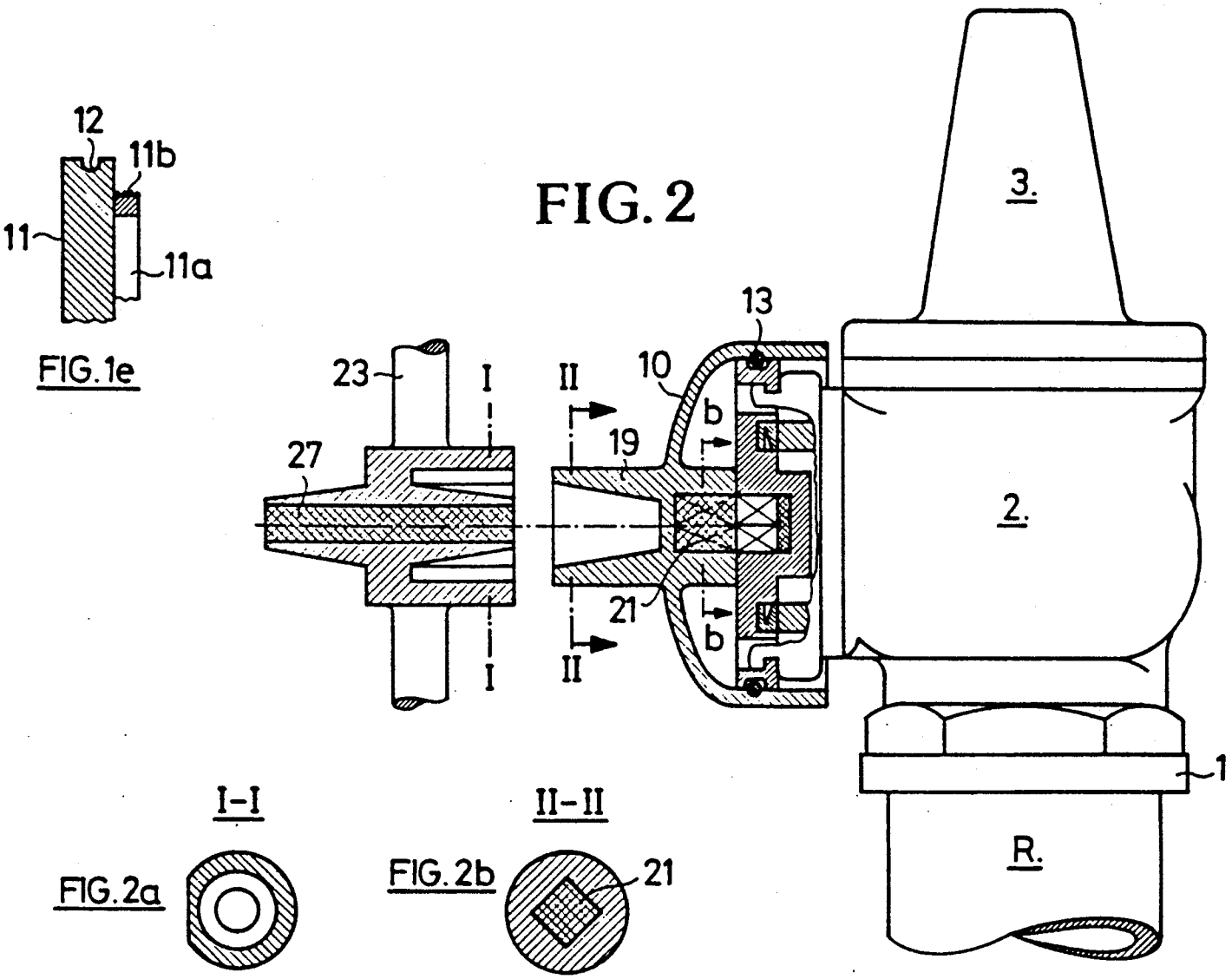

FIG. 2 is a sectional view of the new means in assembled state mounted on a fire hydrant.

FIG. 2*a* is a section on line I—I of FIG. 2.

FIG. 2*b* is a section on line II—II of FIG. 2.

Turning first to FIG. 1 the conventional fire hydrant comprises an internally screw threaded portion 1 which is screwed on a conventional riser R. Extending from portion 1 is a valve chest 2 in which a valve is positioned controlling the flow of water from the hydrant. A valve stem (not seen) is covered by a conical (or otherwise shaped) cap 3. From valve chest 2 a short spigot 4 is branched off, constituting the outflow. Spigot 4 carries on its circumference several claw shaped hooks 5 by means of which—in conventional hydrants—the water hose or the cap shaped cover can be fitted onto the outflow spigot 4 in a bayonet catch manner.

So for the customary fire hydrants. The flow spigot 4 is usually secured by a cap shaped cover 10, whose wall is usually of considerable thickness, but—as has been stated already—is not foolproof against being removed or otherwise tampered with. In the new cap member 10 is provided a septum like plate 11 which in its circumferential edge face has an annular groove 12 in which is placed a springy ring 13 which is urged when placing plate 11 in cap 10. Cap 10 is provided with a circumfertial inner groove 10', which corresponds with annular groove 12, into which springy ring 13 is released when both grooves are in line. As a result the plate 11 is held within the cap 10 rotatably relative to the cap but immovably in axial direction.

In plate 11, there are provided a number of recesses 14 being emplacements for hooks or claws 5 extending from spigot 4. The claws can enter the emplacement through empty spaces therebetween, to be fully received by turning plate 11, as will be described.

At the centre of plate 11 there is positioned a recess 15 on the far end of which is attached a thin magnet 16. At the underside of plate 11 is provided an annular groove 17 into which fits a packing ring 18. At the centre (at top) of cap 10 is provided a two sided sleeve 19, at the outside, and 20 at the inside of cap 10. Both sides of said sleeve are disconnected by a section of the wall of cap 10. The cross section of said two parts are different as can be seen in section A—A and D—D.

The inner part of portion 19 is conical. In between cap 10 and plate 11 there is provided a movable lock block 21 to which reference will be made. As can be seen in FIG. 2, the cap 10 is placed on the outflow spigot 4 with hooks 5 being received in the emplacement 14 which is effected by a tool which comprises a centre member 22 from which extend handles 23. One side of centre member 22 is provided with a conical end 24 which corresponds with the conical recess of portion 19. The second side of member 22 conical portion which is enclosed within circumference wall 25, both of which correspond the inner and outer side of sleeve 19, a notch or key and key way or niche 26 are provided on sleeve 19. Within the inner space of member 22 a magnet 27 is placed.

In order to lock the cap 10 in place, portion 25 of the tool is placed on and in sleeve 19 consequently the negative polarity of magnet 27 will act on lock block 21 which will be thus forced into recess 15. Due to the fact that lock block 21 is longer than the depth of recess 15 said lock block is connecting cap 10 and plate 11. As the cross section of lock block 21 corresponds with the cross section of recess 15 and the recess in part 20, it is quite obvious that as a consequence by turning the hand tool, the plate 11 is turned until hooks 5 register with and enter the emplacements in a way well known with bayonet catch connections. The tool is then withdrawn. The conical side 24 of member 22 is now inserted in sleeve 19 which consequently attracts lock block 21 from recess 15 and thus disconnecting plate 11 from cap 10. The thin magnet 6 is so placed that its negative polarity will prevent lock block 21 from entering into recess 15.

As an alternative, the plate 11 may have a ring shaped extension 11*a* (FIG. 1*b*) which has an external screw thread 11*b*. In that case hooks 5 can be dispensed with and spigot 4 is given an internal screw thread. The cap, in the said alternative construction can then be locked in position, in the way described, i.e. inserting the tool engaging plate 11 by means of 21 and rotating the plate thereby screw connecting the extension 11*a* with the internal screw thread of spigot 4.

It is within the scope of the invention that plate 11 may be provided with outer connecting means, however, the connecting mode between plate 11 and cap 10 renews by means of lock block 21.

We claim:

1. Apparatus for safeguarding a fire hydrant against an unauthorized taking of water from the fire hydrant, comprising:

a cap for covering an outflow port of the fire hydrant, said cap having a recess on an inner side thereof;

a septum-like plate having a recess therein, said septum-like plate being held within said cap and being freely-rotatable within said cap, while being fixed against axial movement relative to said cap;

a movable lock block being located between said cap and said septum-like plate, said movable lock block having a length which is greater than the depth of the recess of said septum-like plate and which is capable of being urged into the recess of said septum-like plate while occupying at least a portion of the recess of said cap so that said cap is able to be connected to said septum-like plate;

a first magnet being positioned at a far end of the recess of said septum-like plate and having a negative polarity which is capable of preventing said movable lock block from entry into the recess of said septum-like plate; and a tool for locking and unlocking said cap onto the outflow port of the fire hydrant, said tool including a center member having a second magnet with a negative polarity which is greater than the negative polarity of said first magnet so that said tool is able to lock said cap to the outflow port of the fire hydrant by urging said movable lock block into the recess of said septum-like plate.

2. The apparatus for safeguarding a fire hydrant according to claim 1, wherein said septum-like plate engages the outflow port of the fire hydrant by means of recessed emplacements in said septum-like plate and hook-or claw-shaped extensions at the periphery of the outflow port, said shaped extensions being received in the recessed emplacements in a bayonet-catch-like manner when said cap is placed on the outflow port of the fire hydrant.

3. The apparatus for safeguarding a fire hydrant according to claim 1, wherein said septum-like plate engages the outflow port of the fire hydrant by means of a ring-shaped, externally screw-threaded extension located on said septum-like plate and an internal screw thread located at the mouth of the outflow port.

4. The apparatus for safeguarding a fire hydrant according to claim 1, wherein said septum-like plate has an annular groove in its circumferential face into which is placed a spring ring for placing said septum-like plate into said cap.

* * * * *